US005257643A

United States Patent [19]

Merrett

[11] Patent Number: 5,257,643

[45] Date of Patent: Nov. 2, 1993

[54] DRY HYDRANT

[75] Inventor: Stanley L. Merrett, Dadeville, Ala.

[73] Assignee: Schlumberger Industries, Inc., Atlanta, Ga.

[21] Appl. No.: 925,677

[22] Filed: Aug. 7, 1992

[51] Int. Cl.[5] ..... E03B 9/02

[52] U.S. Cl. ..... 137/236.1; 137/615; 169/51; 169/91

[58] Field of Search ..... 137/236.1, 590, 615, 137/577, 578, 579; 169/5, 13, 24, 51, 91

[56] References Cited

U.S. PATENT DOCUMENTS

| | | | |
|---|---|---|---|
| 857,519 | 6/1907 | Foster | 137/590 X |
| 901,733 | 10/1908 | O'Sullivan | 169/91 |
| 947,184 | 1/1910 | Lunceford | 137/615 |
| 3,108,440 | 10/1963 | Anderson | 137/236.1 X |
| 3,759,330 | 9/1973 | Rainey et al. | 169/13 X |
| 4,844,121 | 7/1989 | Duke | 137/615 |
| 5,082,013 | 1/1992 | Scheib | 137/236.1 X |

*Primary Examiner*—John Rivell

*Attorney, Agent, or Firm*—Dale V. Gaudier

[57] ABSTRACT

A dry (unpressurized) hydrant utilizes a hydrant pipe formed from PVC. One end engages a sliding swivel mount attached to a post with the other end of the pipe being free to swing and to be placed within a nearby body of water. The free end may include a strainer assembly, also formed of a PVC material. The strainer end may be placed at a predetermined depth within a body of water, such as a lake, pond or the like, by means of a second support located proximate the body of water. Alternatively, the strainer end of the hydrant pipe may be provided with a buoyant float to maintain the level of the strainer end of the hydrant pipe just below the water surface. In another embodiment, the strainer end of the hydrant pipe is provided with a rotating wheel assembly which enables the strainer end of the hydrant pipe to be rolled into position beneath the surface of the body of water. The dry hydrant is formed from inexpensive and lightweight materials and can be stored dry when not in use.

14 Claims, 3 Drawing Sheets

DRY HYDRANT

BACKGROUND OF THE INVENTION

1. Field of the Invention

The invention relates to the field of fire hydrants and, more particularly, to a dry (unpressurized) hydrant which minimizes the possibility of clogging of the hydrant intake and which is suitable for use with bodies of water having variable water levels.

2. Description of the Prior Art

Dry hydrants are a type of fire service hydrant for use where there is no source of pressurized water. For example, in rural areas where there is no centralized water service, water for firefighting is commonly drawn from lakes, ponds, cisterns or the like. Typically, a tanker truck will draw water from a nearby body of water using a flexible hose fitted with a strainer to prevent debris from being drawn into the hose. The tanker will then travel to the site of the fire, where a pumper truck draws water from the tanker to fight the fire.

Such an arrangement is inconvenient and may waste valuable time while the special strainer is being connected to the hose. The strainer assembly must then be properly disposed within the body of water. If placed indiscriminately, the strainer may draw debris, leaves or mud which will clog the strainer and diminish the flow of water to the tanker.

One recent solution to these problems has been to install a so-called "dry-hydrant". A dry hydrant is a length of pipe having one end disposed below the water line of a body of water and the other end exposed at or near the shoreline. Such an arrangement is shown in application Ser. Nos. 07/702,202 and 07/702,203, filed May 17, 1991.

In these arrangements, a length of polyvinylchloride (PVC) pipe is laid in a trench dug from the shoreline of a body of water to enable one end of the pipe to be disposed at a predetermined fixed depth in the water. The other end of the pipe is connected via a 90° elbow to a vertical standpipe. The standpipe is provided with a coupling which enables a standard fire service hose to be connected to the standpipe to draw water through the dry hydrant to a tanker truck.

The portion of the intake pipe disposed in the body of water may be provided with a strainer to prevent debris from being drawn through the dry hydrant and into the tanker.

One drawback to a fixed dry hydrant installation, as described above, is where the body of water is brackish or contains salt water, or contains a lot of marine growth. Barnacles, seaweed, algae, or other marine growth can rapidly cover the intake and strainer of fixed hydrant intake pipe. One solution would be to periodically clean the intake pipe. However, this is a costly solution because of the additional cost of cleaning.

A second drawback to the fixed dry hydrant arrangement is that during times of drought or low water levels in the body of water, the water level may drop below the end of the intake pipe, rendering the dry hydrant ineffective.

It would therefore be beneficial to have available a dry hydrant which is low in cost and easy and inexpensive to install which is less susceptible to the effects of marine growth and where the depth of the intake pipe may be adjusted to ensure a consistent flow of water when needed.

SUMMARY OF THE INVENTION

The present invention meets the foregoing needs by providing a dry hydrant consisting of an unpressurized hydrant pipe, a swivel mounting affixed above the ground near a body of water, with the swivel mounting including a slide assembly adapted to slidingly receive the hydrant pipe, and a support located proximate the body of surface water for supporting one end of the hydrant pipe at a predetermined depth within the body of water.

In a preferred embodiment, the dry hydrant pipe includes a coupling attached at one end adapted for connection to a fire service hose, and a strainer attached at the other end of the hydrant pipe which is to be disposed within the body of water. The strainer may consist of a pipe having a plurality of openings formed along the length therefor. Preferably, the length of the strainer is in the range of four to eight times the diameter of the strainer in order to provide optimum flow characteristics.

In the preferred embodiment, the hydrant pipe and strainer are formed from polyvinylchloride (PVC).

In the preferred embodiment, the swivel mounting includes a post mounted to the ground, and the slide assembly includes a cap slidingly mounted for rotation in a horizontal plane to an exposed end of the swivel post, a U-shaped bracket coupled to the cap, and a cylindrical sleeve for slidingly receiving the hydrant pipe, the sleeve being pivotally connected to the U-shaped bracket to enable the hydrant pipe to move in a vertical plane. Preferably, the sleeve includes at least one roller bearing for slidingly supporting the hydrant pipe within the sleeve.

The dry hydrant may further include a second support for supporting an end of the hydrant pipe remote from the swivel mounting and out of the body of water. The second support may include a support post mounted in the ground and a U-shaped support bracket mounted atop the support post for receiving the hydrant pipe.

In one embodiment, the dry hydrant support includes a guide post mounted in the ground near the body of water and a U-shaped guide bracket mounted atop the guide post to support the end of the hydrant pipe nearest the body of water at a predetermined depth within the body of surface water when the hydrant pipe is located within the U-shaped guide bracket.

In an alternative embodiment, the dry hydrant support includes a wheel mounted for rotation about a portion of the hydrant pipe near the end nearest the body of water, the diameter of the wheel being chosen so as to dispose this end of the hydrant pipe within the body of water when the wheel is disposed proximate the body of water.

In a further embodiment, the dry hydrant support includes a piece of buoyant material disposed near the end of the hydrant pipe nearest the body of water such that when this end of the hydrant pipe is placed within the body of water, the buoyant material supports this end of the hydrant pipe at a predetermined depth within the body of water.

The foregoing arrangements enable a dry hydrant to be assembled from relatively light-weight and inexpensive materials. The design ensures that the hydrant pipe can be supported out of the body of water in a dry condition when not in use. Several different styles of supports are provided to hold the inlet of the hydrant pipe at a predetermined depth in the body of water.

BRIEF DESCRIPTION OF THE DRAWING FIGURES

These and other features and advantages of the present invention will be more clearly understood from the following detailed description of the preferred embodiments, when taken in conjunction with the accompanying drawing figures wherein.

DETAILED DESCRIPTION OF THE PREFERRED EMBODIMENTS

Figure 1:
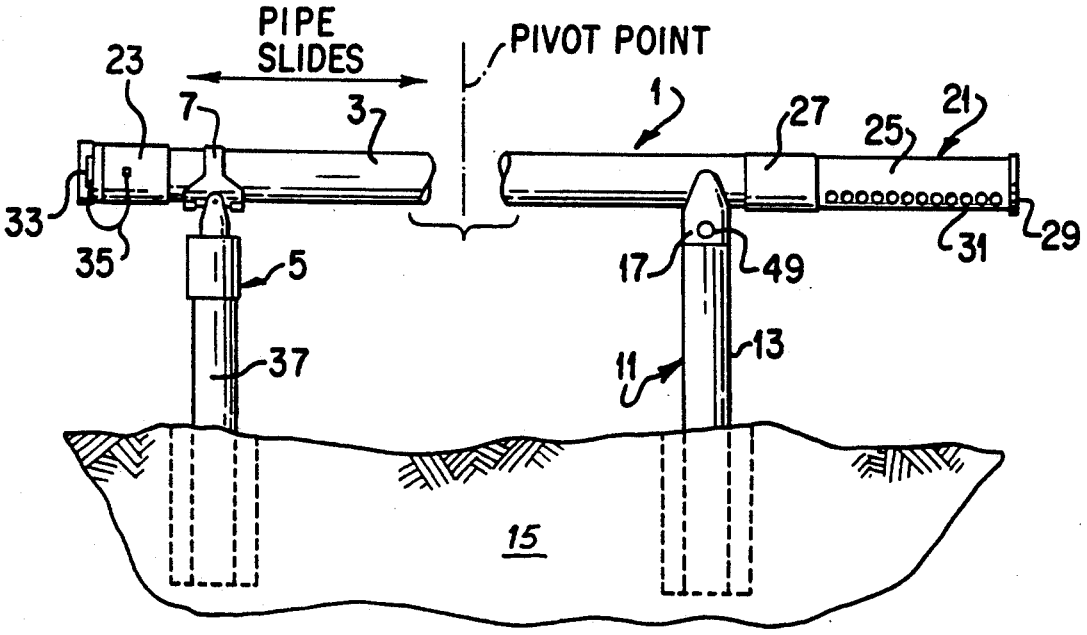
FIG. 1 is a side plan view of a first embodiment of a dry hydrant constructed in accordance with the principles of the present invention.
Figure 2:
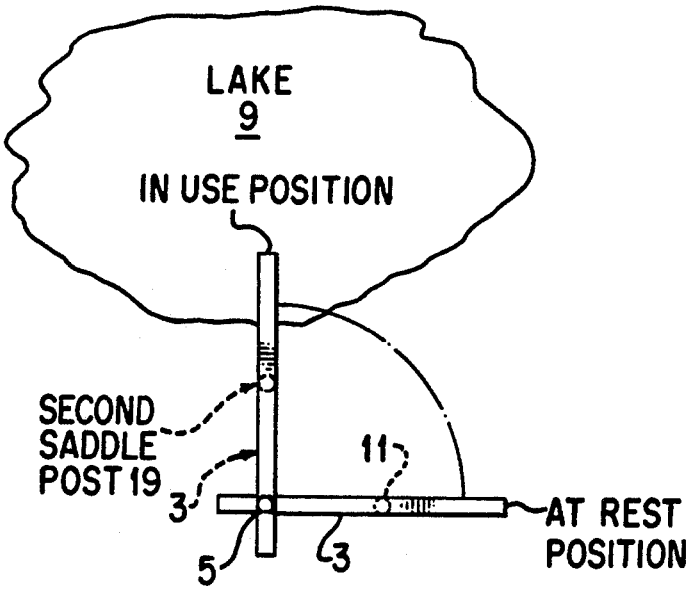
FIG. 2 is a top view of the dry hydrant of FIG. 1.

A dry hydrant 1 constructed in accordance with the principles of the present invention is shown in FIG. 1. Dry hydrant 1 consists of a normally unpressurized hydrant pipe 3 mounted at one end to a swivel mounting 5. The swivel mounting further includes a slide assembly 7, shown in more detail in FIGS. 3, 4 and 5.

At the end of hydrant pipe 3 opposite to where it is mounted to swivel mounting 5 and at a point distant from a body of surface water 9, there is disposed a support 11 for supporting and storing an end of the hydrant pipe 3 remote from swivel mounting 5 out of the body of water 9. Support 11 includes a support post 13 mounting in the ground 15 and a U-shaped support bracket 17 mounted atop support post 13 for removably receiving an end of hydrant pipe 3.

A second support 19 of construction similar to support 11 is disposed proximate body of water 9. The height of second support 19 is chosen such that when the free end of hydrant pipe 3 (the end opposite that engaging swivel mounting 5) is disposed on second support 19, the intake 21 of hydrant pipe 3 is disposed beneath the surface of the body of water 9.

In the preferred embodiment, hydrant pipe 3 and intake assembly 21 are formed from polyvinylchloride (PVC) pipe of a sufficient diameter to allow a a fire service pumper or tanker truck is to be connected to a fire service hose coupling assembly 23 attached to the opposite end of hydrant pie 3.

Intake assembly 21 preferably consists of a strainer 25 connected to hydrant pipe 3 via a PVC coupling 27. Strainer 25 consists of a section of PVC pipe having a plurality of openings 31 formed along its length. Preferably, the length of the strainer is in the range of 4 to 8 times the diameter of the pipe forming the strainer. The open end of strainer 25 may be covered by a solid cap 29. Alternatively, cap 29 may be provided with a plurality of openings. Strainer 25 serves to prevent the intake of debris, fish or the like into hydrant pipe 3.

Openings 31 of strainer 5 are designed to be large enough to admit a free flow of water when strainer 25 is disposed in body of water 9 and negative pressure is applied to hydrant pipe 3 via fire hose service coupling 23 by a fire service pumper or tanker.

Fire service hose coupling assembly 23 is preferably formed from brass, bronze or other non-corroding material and includes a protective cap 33, formed from plastic, metal or the like. Cap 33 is attached to one end of hydrant pipe 3 by means of a retaining lanyard 35.

Coupling assembly 23 is threaded to receive a standard fire service hose (not shown) as is typically carried by fire service pumper trucks and tankers.

Figure 5:
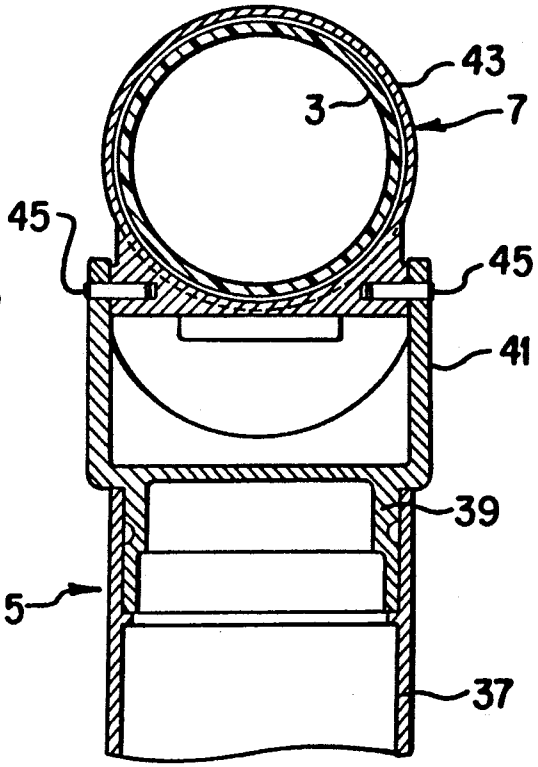
FIG. 5 is a right side cross-sectional view of FIG. 3, taking along lines 3—3.
Figure 4:
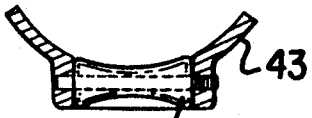
FIG. 4 is a partial right side cross-sectional view of FIG. 3, taken along lines A—A to show the roller support employed by the present invention.
Figure 3:
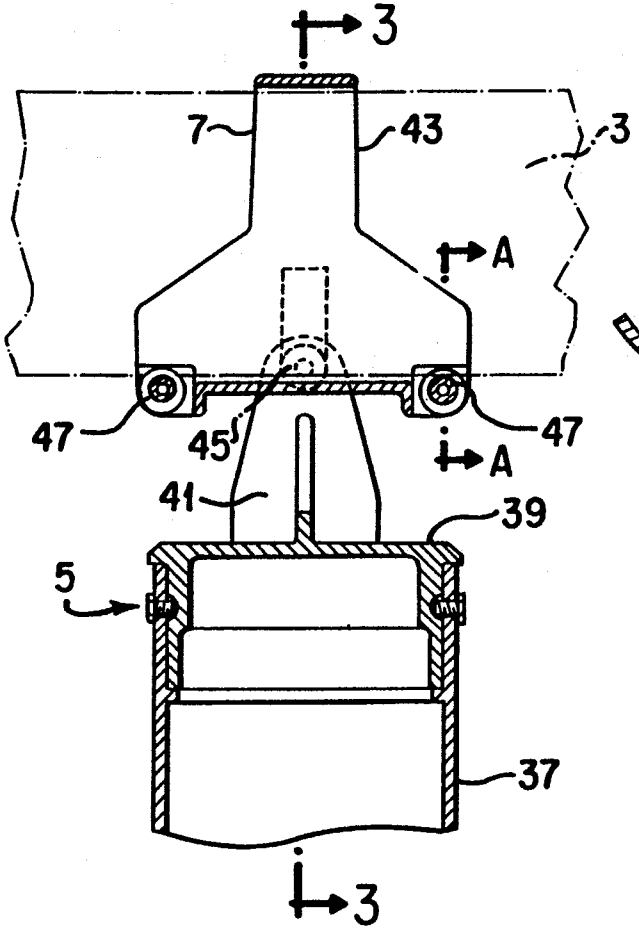
FIG. 3 is a detailed cross-sectional view of the swivel mounting employed by the dry hydrant of FIG. 1.

FIGS. 3, 4 and 5 show in more detail swivel mounting 5 and slide assembly 7. Swivel mounting 5 includes a post 37 mounted to the ground 15. Slide assembly 7 includes a cap 39 mounted to the top of post 37 for rotation in a horizontal plane. A U-shaped bracket 41 is attached to cap 39. Cap 39 and U-shaped bracket 41 can be formed as a single cast piece of brass or bronze. A cylindrical slide or sleeve 43 is pivotally connected to U-shaped bracket 41 by means of pivots 45 to enable hydrant pipe 3 to move in a vertical plane.

As shown in FIG. 3 and in more detail in FIG. 4, cylindrical sleeve 43 can include at least one roller bearing 47 for slidingly supporting hydrant pipe 3 within sleeve 43. Cylindrical sleeve 43 preferably is formed from a noncorrosive metal, such as bronze, or the like. Roller bearing 47 is preferably formed from a plastic material, such as ABS.

In use, hydrant pipe 3 is normally supported when out of service by support assembly 11. U-shaped bracket 17 of support assembly 11 may include an opening 49 for receiving a chain and breakaway lock assembly (not shown) for securing the end of hydrant pipe 3 and U-shaped bracket 17 when not in use. When dry hydrant 1 is to be placed into use, the chain and breakaway lock is removed and the intake end of hydrant pipe 3 is lifted off support 11 by firefighting personnel. The intake end is then be swung over to rest upon second support 19.

Swivel mounting 5 enables the position of the hydrant pipe with respect to the body of water 9 to be readily adjusted and enables rotation in both horizontal and vertical planes. Slide assembly 7 enables the position of the hydrant pipe and intake assembly 21 to be adjusted horizontally so that the intake assembly can be placed at a predetermined depth within the body of water 9. Cap 33 is then removed from the fire service hose coupling assembly 23 and a fire hose connected to the coupling assembly. Water from the body of water 9 is then drawn through strainer 25 into hydrant pipe 3 and then through the fire service hose to a pumper tanker or truck (not shown).

When the firefighters are finished using dry hydrant 1, the fire service hose is uncoupled from hose coupling assembly 23, hydrant pipe 3 is removed from body of water 9, and strainer end 25 is raised above the level of slide assembly 7 to allow any residual water or silt to be drained out through the hose coupling assembly end. Cap 33 is then replaced onto hose coupling assembly 23 and the other end of hydrant pipe 3 is placed back into U-shaped bracket 17 of pipe support 11.

Figure 6:
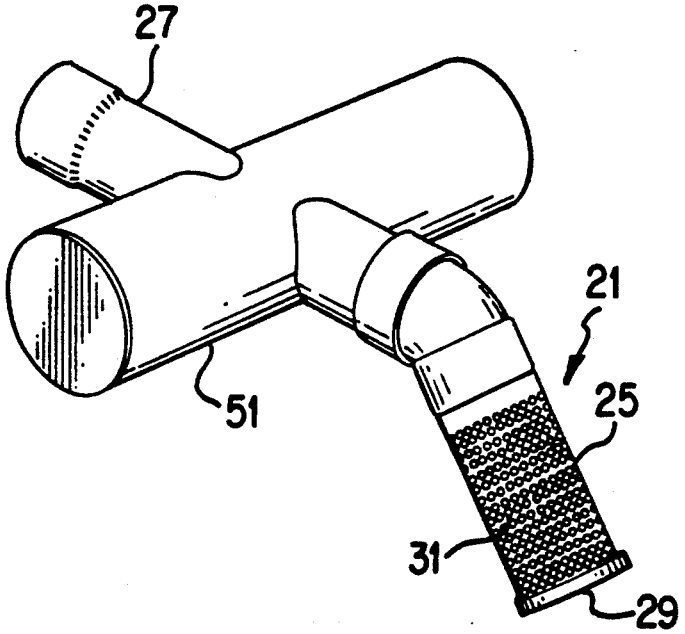
FIG. 6 shows an alternative embodiment for supporting the dry hydrant pipe at a predetermined depth in a body of water.
Figure 7:
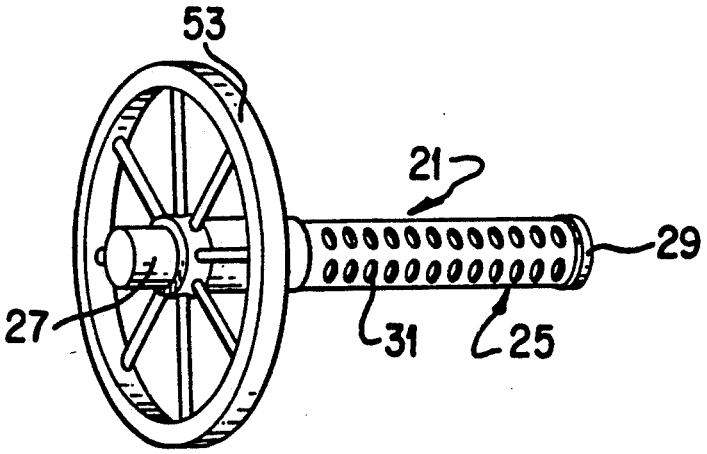
FIG. 7 shows another arrangement for supporting the dry hydrant pipe at a predetermined depth in a body of water.

FIGS. 6 and 7 shown two alternative embodiments for supporting the intake assembly 21 of hydrant pipe 3 at a predetermined depth within the body of water 9. Either of these alternative embodiments may be used in conjunction with or as replacements for second support 19, although second support 19 normally would not be necessary where these alternative embodiments are employed.

FIG. 6 shows an embodiment where intake assembly 21 has a float 51 attached to its upper portion. Float 51 may be formed from any type of buoyant material, such as expanded polystyrene (Styrofoam) or the like. The arrangement of FIG. 6 is particularly useful when dry hydrant 1 will be disposed next to a small body of water whose volume may diminish significantly when water is drawn out through the hydrant when in use. Float 51 ensures that intake assembly 21 will always be disposed beneath the surface of the body of water 9, but not too close to the bottom where it might pick up an excessive amount of silt or debris. The arrangement shown in FIG. 6 is also useful in areas where water levels vary significantly due to drought conditions.

FIG. 7 shows another embodiment in which intake assembly 21 is supported by a wheel assembly 53. Wheel assembly 53 is rotatably mounted about the exterior of coupling 27. The diameter of wheel assembly 53 and the height of post 37 are arranged so that intake assembly 21 will be disposed at a predetermined depth within the body of water 9 when dry hydrant 1 is placed in its operative position. Wheel assembly 53 enables hydrant pipe 3 to be easily wheeled into position with the intake assembly 21 at the desired depth below the surface of the body of water 9. If the arrangement in FIG. 7 is used, it is also possible to dispense with the storage support 11. However, it is preferred to utilize the support 11, in order to have a place to secure the free end of hydrant pipe 3 when not in use.

From the foregoing, it can be seen that the present invention provides a low cost dry hydrant assembly which can be readily stored in a secure manner out of the water. The dry hydrant of the present invention can be easily manufactured out of inexpensive and lightweight materials. Furthermore, the various arrangements shown enable the intake of the dry hydrant to be placed at a predetermined depth of the water or to be adjusted if the surface of the water should vary.

While the present invention has been described in considerable detail, various modifications and improvements will occur to those skilled in the art. Therefore, the foregoing detailed description of the preferred embodiments should be viewed as illustrative, not limitative, of the invention which is defined in the appended claims.

What is claimed is:

1. An above-ground dry hydrant comprising:

an unpressurized hydrant pipe;

a swivel mounting affixed above the ground near a body of surface water, the swivel mounting including a slide assembly adapted to slidingly receive the hydrant pipe; and a support located proximate the body of surface water for supporting one end of the hydrant pipe at a predetermined depth within the body of water.

2. The dry hydrant of claim 1 wherein the hydrant pipe includes a coupling attached at one end adapted for connection to a fire service hose.

3. The dry hydrant of claim 1 wherein at least the hydrant pipe is formed from polyvinylchloride.

4. The dry hydrant of claim 1 wherein said hydrant pipe includes a strainer attached at said end of said hydrant pipe which is to be disposed within the body of water.

5. The dry hydrant of claim 4 wherein the strainer is a pipe having a plurality of openings formed along the length thereof.

6. The dry hydrant of claim 5 wherein the length of the strainer is in the range of four to eight times the diameter of the strainer.

7. The dry hydrant of claim 6 wherein the strainer is formed from polyvinylchloride.

8. The dry hydrant of claim 1 wherein the swivel mounting includes a post mounted to the ground, and the slide assembly includes a cap mounted for rotation in a horizontal plane to an exposed end of the swivel post, a U-shaped bracket coupled to the cap, and a cylindrical sleeve for slidingly receiving the hydrant pipe, the sleeve being pivotally connected to the U-shaped bracket to enable the hydrant pipe to move in a vertical plane.

9. The dry hydrant of claim 8 wherein the sleeve includes at least one roller bearing for slidingly supporting the hydrant pipe within the sleeve.

10. The dry hydrant of claim 1 further including a second support for supporting an end of the hydrant pipe remote from the swivel mounting and out of the body of water.

11. The dry hydrant of claim 10 wherein the second support includes a support post mounted in the ground and a U-shaped support bracket mounted atop the support post for receiving the hydrant pipe.

12. The dry hydrant of claim 1 wherein the support includes a guide post mounted in the ground near the body of water and a U-shaped guide bracket mounted atop the guide post to support said one end of the hydrant pipe nearest the body of water at a predetermined depth within the body of surface water when the hydrant pipe is located within the U-shaped guide bracket.

13. The dry hydrant of claim 1 wherein the support includes a wheel mounted for rotation about a portion of the hydrant pipe near said end nearest the body of water, the diameter of the wheel being chosen so as to dispose said end of the hydrant pipe within the body of water when the wheel is disposed proximate the body of water.

14. The dry hydrant of claim 1 wherein the support includes a piece of buoyant material disposed near said end of the hydrant pipe nearest the body of water such that when said end of the hydrant pipe is placed within the body of water, the buoyant material supports said end of the hydrant pipe at a predetermined depth within the body of water.

* * * * *